US007134295B2

(12) United States Patent
Maekawa

(10) Patent No.: US 7,134,295 B2
(45) Date of Patent: Nov. 14, 2006

(54) COMPRESSOR UNIT AND REFRIGERATOR USING THE UNIT

(75) Inventor: Yasunori Maekawa, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 165 days.

(21) Appl. No.: 10/504,877

(22) PCT Filed: Apr. 9, 2003

(86) PCT No.: PCT/JP03/04474

§ 371 (c)(1),
(2), (4) Date: Aug. 17, 2004

(87) PCT Pub. No.: WO03/085265

PCT Pub. Date: Oct. 16, 2003

(65) Prior Publication Data

US 2005/0103036 A1 May 19, 2005

(30) Foreign Application Priority Data

Apr. 10, 2002 (JP) ..... 2002-108117

(51) Int. Cl.
*F25B 1/00* (2006.01)
*F25B 49/00* (2006.01)
*F04B 49/00* (2006.01)

(52) U.S. Cl. ..... 62/228.1; 62/230; 417/14

(58) Field of Classification Search ..... 62/228.1, 62/228.5, 229, 230; 417/14, 292
See application file for complete search history.

(56) References Cited

U.S. PATENT DOCUMENTS 4,179,899 A * 12/1979 Katayama ..... 62/228.1
4,736,595 A * 4/1988 Kato ..... 62/160
5,709,098 A * 1/1998 Itoh et al. ..... 62/228.4
6,065,298 A * 5/2000 Fujimoto ..... 62/230

FOREIGN PATENT DOCUMENTS

JP 4-313645 A 11/1992
JP 6-193945 A 7/1994
JP 2000-227074 A 8/2000

* cited by examiner

*Primary Examiner*—Marc Norman
(74) *Attorney, Agent, or Firm*—Birch Stewart Kolasch & Birch, LLP

(57) ABSTRACT

A compressor unit includes a compressor, an inverter for driving the compressor, and an over-current protective device for protecting the inverter against an output over-current. A control part controls the output voltage of the inverter when the compressor is started based on a ambient temperature detected by a temperature sensor so that the input current of the inverter does not exceed the working current value of the over-current protective device having temperature characteristics varying according to the ambient temperature. Thereby, a start torque can be increased by increasing the output voltage of the inverter without operating the over-current protective device when the compressor is stated at a low temperature when a start load is increased.

4 Claims, 4 Drawing Sheets

COMPRESSOR UNIT AND REFRIGERATOR USING THE UNIT

TECHNICAL FIELD

The present invention relates to a compressor unit and a refrigerator using the unit.

BACKGROUND ART

Conventionally, there has been a compressor unit that has been used in a refrigerator having refrigerant circuits. The compressor unit has a compressor, an inverter for driving the compressor, and an over-current protective device for protecting the inverter against an output over-current. When the compressor is started, an inverter output voltage is set according to a working current value of the over-current protective device. That is, the inverter output voltage is set so that an inverter output current does not exceed the working current value of the over-current protective device and so that a maximum starting torque is gained. The over-current protective device, however, has characteristics in which a high ambient temperature decreases the working current value and in which a low ambient temperature increases the working current value, as shown in FIG. 6. When the compressor is started at a low ambient temperature, accordingly, a problem is caused in that the inverter output voltage cannot be increased though there is room for increase in the inverter output voltage resulting in increase in starting torque. When the compressor is started at a low temperature, in particular, a load is increased by increase in viscosity of oil in the compressor, accumulation of liquid refrigerant or the like. In such a case, therefore, the larger the driving torque is, the better.

DISCLOSURE OF THE INVENTION

It is an object of the present invention to provide a compressor unit by which a starting torque can be increased by increasing an output voltage of an inverter without operating an over-current protective device when a compressor is started at a low temperature when a start load is increased, and to provide a refrigerator using the unit.

In order to achieve the object, the present invention provides a compressor unit comprising a compressor, an inverter for driving the compressor, and an over-current protective device for protecting the inverter against an output over-current, the compressor unit characterized in that a working current value of the over-current protective device has temperature characteristics varying according to an ambient temperature, the compressor unit further comprising:

a temperature sensor for detecting the ambient temperature, and a control part for controlling an output voltage of the inverter on occasion of start of the compressor on basis of the ambient temperature detected by the temperature sensor.

In accordance with the compressor unit having a configuration described above, in which the working current value of the over-current protective device has the temperature characteristics varying according to the ambient temperature, the compressor is started by an inverter output voltage such that an output current or an input current of the inverter, for example, which is compared with the working current value does not exceed the working current value corresponding to the ambient temperature and thus the inverter output voltage can be increased without activating the over-current protective device when the compressor is started at a low temperature when a start load is increased, so that the start of the compressor can be facilitated by increase in a starting torque.

In a compressor unit of an embodiment, the control part determines the inverter output voltage on occasion of the start on basis of the ambient temperature detected by the temperature sensor so that an output current or an input current of the inverter is smaller than and in vicinity of the working current value of the over-current protective device corresponding to the ambient temperature detected by the temperature sensor.

In accordance with the compressor unit of the embodiment, the inverter output voltage resulting in the output current or the input current of the inverter that is smaller than and in vicinity of the working current value of the over-current protective device corresponding to the ambient temperature detected by the temperature sensor is determined on basis of the ambient temperature detected by the temperature sensor. Therefore, the inverter output voltage on occasion of the start can be made as high as possible in accordance with the temperature characteristics of the working current value of the over-current protective device.

In a compressor unit of an embodiment, the working current value of the over-current protective device has temperature characteristics in which the lower ambient temperature results in the larger working current value and in which the higher ambient temperature results in the smaller working current value, and wherein the control part determines the inverter output voltage on occasion of the start on basis of the ambient temperature detected by the temperature sensor so that the lower the ambient temperature detected by the temperature sensor is, the higher the inverter output voltage on occasion of the start is and so that the higher the ambient temperature detected by the temperature sensor is, the lower the inverter output voltage on occasion of the start is.

In accordance with the compressor unit of the embodiment, in which the lower ambient temperature results in the larger working current value of the over-current protective device and in which the higher ambient temperature results in the smaller working current value of the over-current protective device, the lower the ambient temperature detected by the temperature sensor is, the higher the inverter output voltage on occasion of the start is made, and the higher the ambient temperature detected by the temperature sensor is, the lower the inverter output voltage on occasion of the start is made. Thus the inverter output voltage on occasion of the start can be made as high as possible in accordance with the temperature characteristics of the working current value of the over-current protective device.

A refrigerator of the invention is characterized in that the refrigerator includes the compressor unit.

In accordance with the refrigerator having a configuration described above, the inverter output voltage can be increased without activating the over-current protective device on occasion of start at a low temperature when a start load is increased, so that the start of the compressor can be facilitated by increase in a starting torque.

BEST MODE FOR CARRYING OUT THE INVENTION

Hereinbelow, a compressor unit of the invention and a refrigerator using the unit will be described in detail with reference to embodiments shown in the accompanying drawings.

Figure 1:
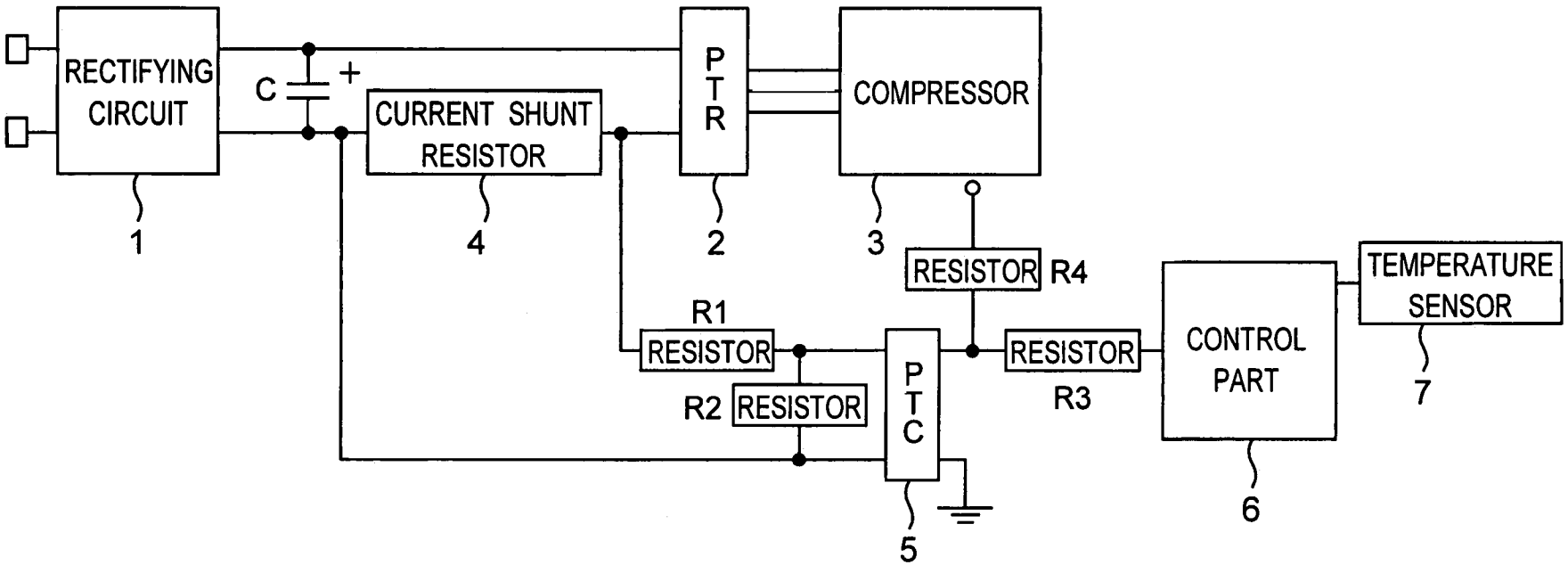
FIG. 1 is a schematic configuration of a compressor unit in accordance with an embodiment of the invention.

FIG. 1 is a schematic configuration of a compressor unit for use in an air conditioner in accordance with an embodiment of the invention. The compressor unit has a rectifying circuit 1 to which an AC power supply (not shown) is connected, an inverter 2 for converting a DC voltage from the rectifying circuit 1 into an AC voltage, and a compressor 3 that is driven by an output voltage from the inverter 2. An output terminal on a positive electrode side of the rectifying circuit 1 is connected to one input terminal of the inverter 2, and an output terminal on a negative electrode side of the rectifying circuit 1 is connected through a current shunt resistor 4 to the other input terminal of the inverter 2. Between both the output terminals of the rectifying circuit 1 is connected a smoothing capacitor C. One end of the current shunt resistor 4 on a side of the inverter 2 is connected through a resistor $R_1$ to one input terminal (on an anode side of a built-in light emitting diode) of a photocoupler 5, and the other end of the current shunt resistor 4 on a side of the rectifying circuit 1 is connected to the other input terminal (on a cathode side of the built-in light emitting diode) of the photocoupler 5. Between both the input terminals of the photocoupler 5 is connected a resistor $R_2$. One output terminal (on a collector side of a built-in output transistor) of the photocoupler 5 is connected through a resistor $R_3$ to an input terminal of a control part 6, and the other output terminal (on an emitter side of the built-in output transistor) of the photocoupler 5 is connected to a ground. A temperature sensor 7 for detecting an ambient temperature is connected to an input terminal of the control part 6.

Figure 6:
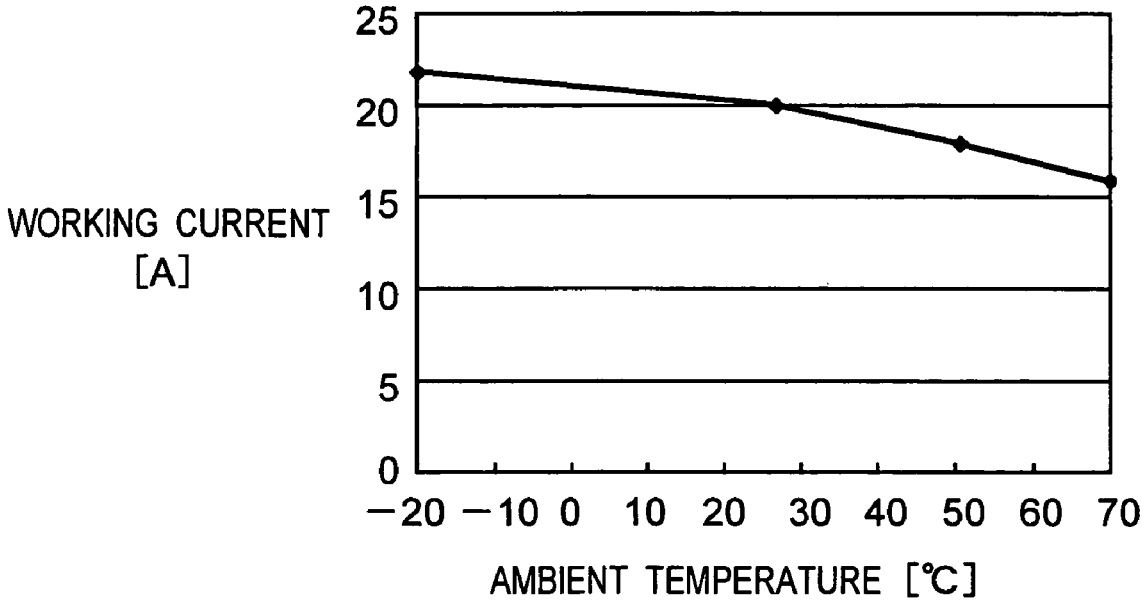
Fig.6 BACKGROUND ART
FIG. 6 is a diagram showing a temperature characteristic of working current value of an over-current protective device.

The control part 6 is composed of a microcomputer, an input-output circuit, and the like, and controls the output voltage of the inverter 2. The shunt resistor 4, the photocoupler 5, and the resistors $R_1$ to $R_4$ form an over-current protective device. When an input current for the inverter 2 becomes larger than a specified current while the compressor 3 is operated by the inverter 2, a voltage across the current shunt resistor 4 is increased and the photocoupler 5 is turned on so that activation of the over-current protective device is notified to the control part 2. Upon the activation of the over-current protective device, the control part 2 turns off or reduces the output voltage of the inverter 2 and thereby prevents damage to the inverter 2 that may result from an output over-current. In the over-current protective device configured as described above, working current values vary according to a temperature characteristic of the photocoupler 5. In the temperature characteristic, as shown in FIG. 6, the lower an ambient temperature is, the larger the working current value is; the higher the ambient temperature is, the smaller the working current value is.

Figure 2:
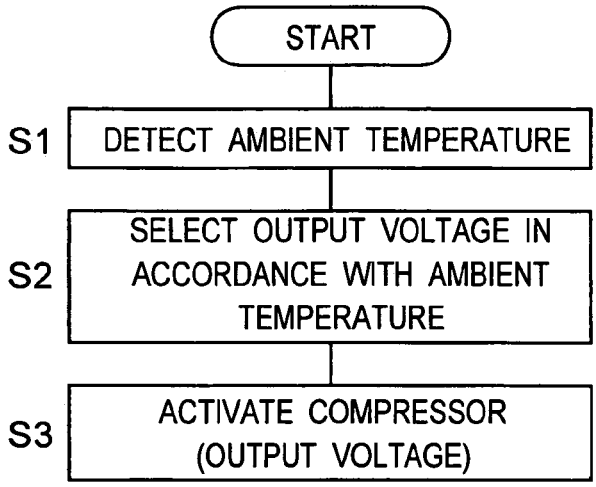
FIG. 2 is a flowchart for illustrating operations of a control part of the compressor unit.

When the compressor 3 is started in the compressor unit configured as described above, the control part 6 is activated to control the output voltage of the inverter 2 in accordance with a flowchart of FIG. 2. Upon start of processing, in FIG. 2, an ambient temperature is detected by the temperature sensor 7 in a step S1. The processing subsequently goes to a step S2, and an output voltage of the inverter 2 is selected in accordance with the ambient temperature detected by the temperature sensor 7. The processing then goes to a step S3, and the output voltage selected in the step S2 is outputted from the inverter 2 so as to drive the compressor 3.

As the ambient temperature that is detected by the temperature sensor 7, a temperature of electrical equipment (not shown) is preferably detected but a temperature of outside air, a discharge pipe of the compressor 3, a heat exchanger, a radiating fin (for power transistors of the inverter) or the like may be used.

Figure 3A:
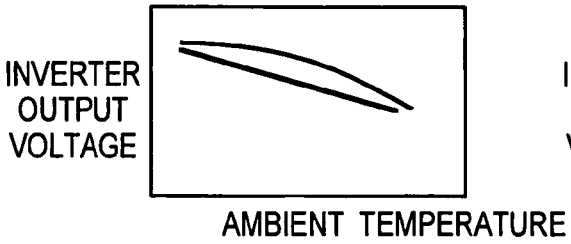
FIG. 3A and FIG. 3B are diagrams showing relations between ambient temperatures and inverter outputs for determining an inverter output voltage on occasion of start of a compressor.
Figure 3B:
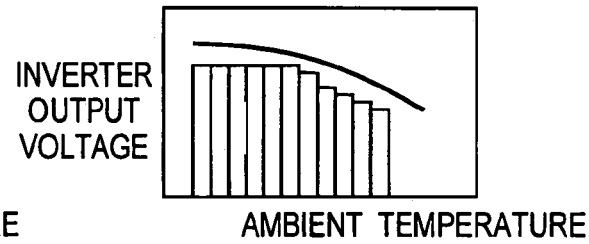

For the selection of the output voltage of the inverter 2 in the step S2, an inverter output voltage that comes short of the working current value is predetermined for each value of the ambient temperature on basis of the temperature characteristic (shown in FIG. 6) of the working current value of the over-current protective device. That is, a relation between the inverter output voltages and the ambient temperatures is made similar to the temperature characteristic of the working current value of the over-current protective device. As shown in FIG. 3A, for example, inverter output voltages may be determined so as to have a linear characteristic expressed by a linear expression approximate to a curve that shows a relation between the inverter output voltages and the ambient temperatures or, as shown in FIG. 3B, an inverter output voltage may be determined for every certain range of the temperature. Thus the inverter output voltage on occasion of the start is determined so that the input current for the inverter 2 is smaller than and in vicinity of a working current value of the over-current protective device corresponding to the ambient temperature detected by the temperature sensor 7.

Figure 4:
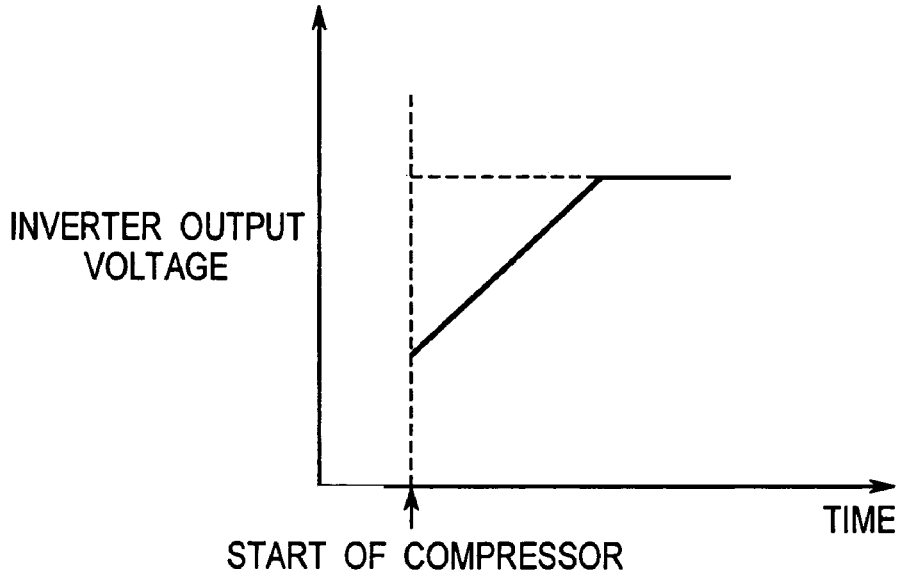
FIG. 4 is a diagram showing change in initial inverter output voltage with lapse of time on occasion of start.

The inverter output voltage that has been determined as described above may be outputted fully on occasion of the start of the compressor 3 or, as shown in FIG. 4, the output voltage may be increased gradually from a voltage lower than the determined inverter output voltage. A period of time for which the initial voltage on occasion of the start of the compressor 3 is outputted corresponds to a period of time that elapses until a motor in the compressor 3 starts rotating and therefore may be short, i.e., on the order of 100 msec. Extension of the period of time according to circumstances is, however, effective for addressing increase in oil viscosity, accumulation of liquid refrigerant or the like on occasion of the start at low temperature.

Figure 5:
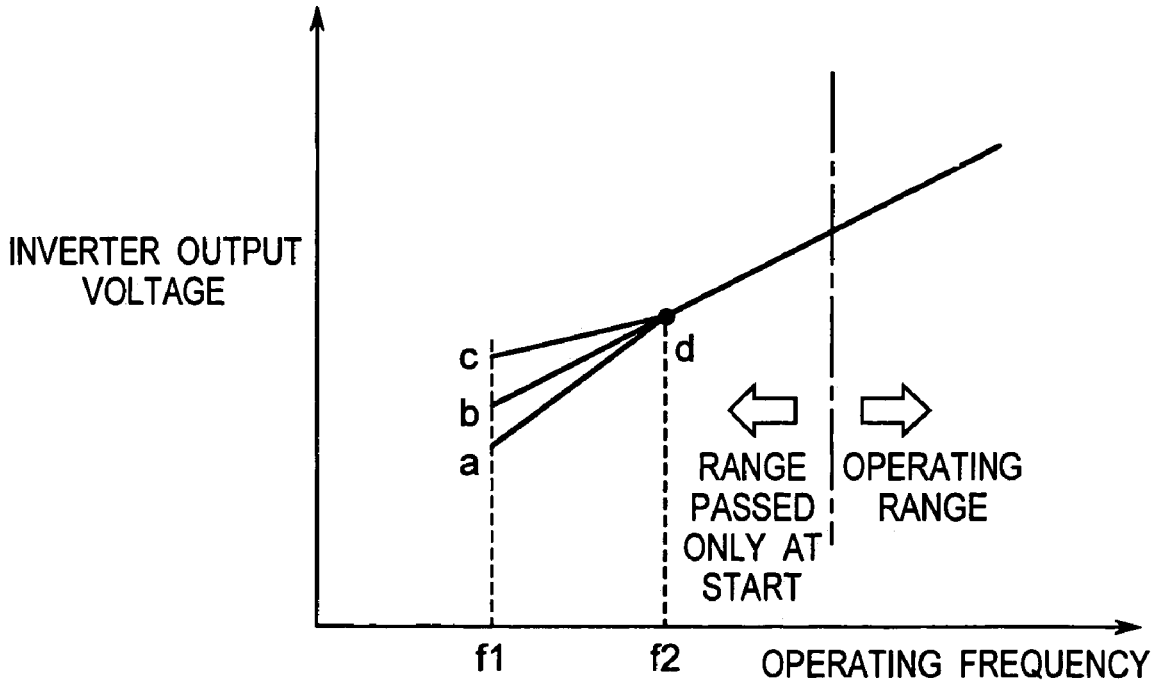
FIG. 5 is a diagram showing relations between operating frequencies and inverter output voltages.

On condition that an induction motor is used as the motor in the compressor 3, a relation between the inverter output voltages and operating frequencies has a linear characteristic (hereinbelow, referred to as VF characteristic) and an inverter output voltage is determined in accordance with the VF characteristic. A change in the initial inverter output voltage in accordance with ambient temperatures causes a deviation from the VF characteristic. When an inverter output voltage corresponding to a frequency $f_1$ at the start is changed, as shown in FIG. 5, among points a, b, and c in accordance with ambient temperatures, the VF characteristic is switched to lines that link an inverter output voltage d corresponding to a frequency $f_2$ (outside an operating range of the compressor 3) and the inverter output voltages a, b, and c corresponding to the frequency $f_1$. Thus the deviation that occurs between the inverter output voltages changed in accordance with initial ambient temperatures and the VF characteristic is resolved.

Though the embodiment has been described with reference to the compressor unit used for the air conditioner as a refrigerator, the compressor unit of the invention may be used not only for air conditioners but for other refrigerators.

In the embodiment, the inverter input current detected by the shunt resistor 4 has a pulse shape, and the inverter output current that flows from the three-phase AC voltage output inverter 2 to the compressor 3 has an AC waveform. A peak value of the inverter output current is generally as large as a peak value of the inverter input current that is detected by the shunt resistor 4 and that has the pulse shape. On basis of this principle, a peak value of a motor current can be found by the shunt resistor 4.

Though the shunt resistor 4 is provided on a negative electrode side of the inverter 2 in the embodiment, the shunt resistor may be provided on a positive electrode side of the inverter in order to detect the inverter input current. Though there is used the over-current protective device composed of the shunt resistor 4, the photocoupler 5, and the resistors $R_1$ to $R_4$, the over-current protective device is not limited thereto, and there may be used over-current protective devices having other configurations or having different temperature characteristics of working current value. Over-current protection in the embodiment is performed with use of the input current for the inverter 2 that is detected by the shunt resistor 4; however, current detecting means may be provided on the output side of the inverter and the protection may be performed with use of the inverter output current detected by the current detecting means. In the embodiment, the current is detected on the negative electrode side because current measurement on the positive electrode side of the inverter increases a drift (floating) of the current value and because current measurement on the output side of the inverter requires a complicated detecting circuit.

The invention claimed is:

1. A compressor unit comprising a compressor, an inverter for driving the compressor, and an over-current protective device for protecting the inverter against an output over-current, wherein a working current value of the over-current protective device has temperature characteristics varying according to an ambient temperature, the compressor unit further comprising:

a temperature sensor for detecting the ambient temperature, and a control part for controlling an output voltage of the inverter on occasion of start of the compressor on basis of the ambient temperature detected by the temperature sensor, wherein the working current value of the over-current protective device has temperature characteristics in which the lower ambient temperature results in the larger working current value and in which the higher ambient temperature results in the smaller working current value, and wherein the control part determines the inverter output voltage on occasion of the start on basis of the ambient temperature detected by the temperature sensor so that the lower the ambient temperature detected by the temperature sensor is, the higher the inverter output voltage on occasion of the start is and so that the higher the ambient temperature detected by the temperature sensor is, the lower the inverter output voltage on occasion of the start is.

2. The refrigerator including the compressor unit as claimed in claim 1.

3. The compressor unit as claimed in claim 1, wherein the control part determines the inverter output voltage on occasion of the start on basis of the ambient temperature detected by the temperature sensor so that an output current or an input current of the inverter is smaller than and in vicinity of the working current value of the over-current protective device corresponding to the ambient temperature detected by the temperature sensor.

4. The refrigerator including the compressor unit as claimed in claim 3.

* * * * *